US006048269A

United States Patent [19]

Burns et al.

[11] Patent Number: 6,048,269

[45] Date of Patent: Apr. 11, 2000

[54] COINLESS SLOT MACHINE SYSTEM AND METHOD

[75] Inventors: James G. Burns; Robert R. Maxey, both of Las Vegas, Nev.

[73] Assignee: MGM Grand, Inc., Las Vegas, Nev.

[21] Appl. No.: 08/007,742

[22] Filed: Jan. 22, 1993

[51] Int. Cl.[7] ..... A63F 9/00; A63F 9/24

[52] U.S. Cl. ..... 463/25; 463/29; 463/42

[58] Field of Search ..... 273/138 A, 138 R, 273/143 A, 85 CP; 463/16, 17, 25, 29, 43, 42; 235/379, 380, 381; 902/23

[56] References Cited

U.S. PATENT DOCUMENTS

| | | | |
|---|---|---|---|
| 4,322,612 | 3/1982 | Lange | 235/419 |
| 4,335,809 | 6/1982 | Wain | 273/138 A |
| 4,373,726 | 2/1983 | Churchill et al. | 273/138 |
| 4,494,197 | 1/1985 | Troy et al. | 364/412 |
| 4,575,622 | 3/1986 | Pellegrini | 273/138 A |
| 4,626,672 | 12/1986 | Sapitowicz et al. | 235/480 |
| 4,636,951 | 1/1987 | Harlick | 364/412 |
| 4,669,730 | 6/1987 | Small | 273/138 |
| 4,689,742 | 8/1987 | Troy et al. | 364/412 |
| 4,832,341 | 5/1989 | Muller et al. | 273/139 |
| 4,880,237 | 11/1989 | Kishishita | 273/138 A |
| 4,882,473 | 11/1989 | Bergeron et al. | 273/138 A |
| 4,937,853 | 6/1990 | Brule et al. | 379/96 |
| 5,007,641 | 4/1991 | Seidman | 273/138 A |
| 5,025,139 | 6/1991 | Halliburton, Jr. | 235/379 |
| 5,038,022 | 8/1991 | Lucero | 235/380 |
| 5,039,848 | 8/1991 | Stoken | 235/381 |
| 5,042,809 | 8/1991 | Richardson | 273/85 CP |
| 5,080,364 | 1/1992 | Seidman | 273/138 |
| 5,096,195 | 3/1992 | Gimmon | 273/138 A |
| 5,113,900 | 5/1992 | Gabrius et al. | 273/138 A |
| 5,119,295 | 6/1992 | Kapur | 364/412 |
| 5,135,224 | 8/1992 | Yamamoto et al. | 273/143 R |
| 5,265,874 | 11/1993 | Dickinson et al. | 273/138 A |
| 5,277,424 | 1/1994 | Wilms | 273/138 A |
| 5,290,033 | 3/1994 | Bittner et al. | 273/138 A |
| 5,342,047 | 8/1994 | Heidel et al. | 273/138 A |
| 5,373,440 | 12/1994 | Cohen et al. | 273/139 |

FOREIGN PATENT DOCUMENTS

| | | | |
|---|---|---|---|
| 3406058 | 8/1985 | Germany | 273/138 A |
| 1-277588 | 11/1989 | Japan | A63F 7/02 |
| 3242179 | 10/1991 | Japan | 273/121 B |
| 4051982 | 2/1992 | Japan | 273/121 B |
| 4053580 | 2/1992 | Japan | 273/121 B |
| 4189384 | 7/1992 | Japan | 273/121 B |
| 8101664 | 6/1981 | WIPO | 273/138 A |

OTHER PUBLICATIONS

Berry, K.M. "All About/Gambling Equipment", *The New York Times,* Sep. 16, 1990 p. F–4.

"New Brunswick's Video Lottery Off and Running", *Playmeter,* Feb. 1991, p. 15.

*Primary Examiner*—Jessica J. Harrison

*Attorney, Agent, or Firm*—Loeb & Loeb LLP; F. Jason Far-hadian, Esq.

[57] ABSTRACT

A gaming apparatus which comprises a slot machine capable of accepting either paper currency, preprinted coupons, or cash out slips. The slot machine also includes a printer that prints and dispenses cash out slips which include a bar code representing a unique identification that provides the amount of "winnings". The cash out slips can be scanned into a separate currency dispenser at a Cashier's Station for receiving currency, either from the dispenser or from an attendant. A central processing unit (CPU) generates the unique codes for regulating the game to be played, the wager limits of the game and the validity of the free play coupons or the cash out tickets. The above gaming system avoids having to use coins or tokens in the operation of slot machines.

76 Claims, 3 Drawing Sheets

COINLESS SLOT MACHINE SYSTEM AND METHOD

BACKGROUND

At current the time, gaming apparatus, including slot machines, pin ball machines and other coin operated games, typically use coins to operate the machines. The coins are inserted in a slot in the gaming apparatus and the player then operates the gaming apparatus based on the value of the coins deposited. Some gaming apparatus, rather than dispensing the players winnings after each play, store the value of the winnings and indicate the remaining "credit" of the player. When the player wishes to stop playing, the coins are then dispensed into an external tray of the gaming apparatus. While the present invention is described in relationship to a slot machine, the term slot machine is used to denote any gaming apparatus that receives money in some form and pays out money or credits.

In some instances, such as when the amount of the winnings exceeds the stored coins within the slot machine, an attendant is notified that additional payment is necessary.

The use of coins in the casino operation for the playing of slot machines has presented a great number of well-known problems that over the years casinos have attempted to eliminate. These problems, among others, are: (1) coins take up a lot of space and have to be frequently emptied from the slot machine, requiring the play of the slot machine to be interrupted; (2) a security guard is required to be present, together with someone to physically move the coins to a central location; (3) the coins then have to be separated, counted, stored and rolled for reuse; (4) coins are heavy and bulky. The amount collected in a typical day at an average casino may weigh more than two tons; (5) coins are dirty; and (6) coins required to operate slot machines represent an inventory (working capital) need of several million dollars. Each of the above tasks takes a substantial amount of time, resources, and costs money. The collecting, counting and depositing of the coins may involve dozens of people.

In addition to the problems with the physical collection of the coins, there are additional problems associated with the operation of slot machines which use coins. The coins take up a lot of space within the slot machines and the slot machines must be designed so as to incorporate space for storing the coins. The use of coins to play slot machines involves a great number of transactions, including getting change for paper currency. This requires numerous change attendants to constantly walk around near the slot machines so that the players do not have to leave the machines. Also containers have to be given to the players for carrying the coins to and from the slot machines. Paper wrappers from the coins are thrown on the ground near the slot machines. Also coins have to be counted by the change attendants after the players stop playing.

There are slot machines that accept coupons or accept paper currency. However, such slot machines also accept coins.

To overcome some of the above disadvantages in using coins for slot machines, there have been a number of attempts to devise a system of money free slot machines.

The principal approach has been to use some form of credit card or debit card having a user identification code that is inserted into the slot machine, and by use of a Central Processing Unit the identification of the user and the amount of credit available to the user is controlled. A debit card is a card issued by a casino based on a prior cash deposit by the player, much in the same way used in some modem subway systems.

One system uses credit or debit cards having a magnetic strip representing a predetermined value, which can be read by a slot machine equipped with a credit card reader, in place of money. The credit card reader is connected to a central processing unit that determines the value of the card and the value of play.

While the above systems avoid the use of money, they are susceptible to certain abuses which have made them generally unacceptable to the casino industry. Predetermined credit or debit cards are inconvenient and require the casino to establish credit limits for the user, and are susceptible to counterfeiting or use by an unauthorized person. Some identification or other means of assuring the validity of the cards or user is necessary. As a result, these systems do not permit the user to treat the predetermined credit cards as though the cards were money. This changes the gambling habits of the player, which is undesirable.

In the patent to Kapur, U.S. Pat. No. 5,119,295 a lottery ticket dispensing apparatus is disclosed which operates by use of paper currency, credit cards or pay slips. The player obtains a pay slip upon payment of money. The pay slip is coded and can then be ??? into its lottery gaming apparatus. The apparatus prints out a lottery ticket, but has no means for printing any slip corresponding to a winning lottery ticket.

SUMMARY OF INVENTION

In the gaming apparatus of the present invention a slot machine which does not use coins is described. Slot machines are typically activated initially by the insertion of coins into the slot machine through a slot, thus the origin of the name "slot machine".

In the present invention no coins are inserted into the slot machine. The slot machine of the present invention includes an optical paper currency reader that is capable of recognizing and validating paper currency and providing the player with the credit corresponding to the value of the currency.

The slot machine of the present invention also includes a bar code reader that can read and validate pre-printed free play coupons, or printed cash out slips previously printed by the gaming apparatus with a bar code representing the value of the coupon or cash out slip. The slot machine also includes a printer that prints and dispenses cash out slips having the value of the cash out slip represented by a bar code. The printer is controlled by a Central Processing Unit (CPU) associated with the slot machine.

Each individual slot machine includes a commercially available Universal Interface Board (UIB) that collects the slot machine data, such as the codes from the bar codes and the output of the paper currency reader and formats it and then transmits it to the CPU. The CPU is located in a secured office at the casino. The printed cash out slips can be accepted by the slot machines in order to obtain credit to play the slot machine or can be inserted or scanned into a separate device at a change station to obtain actual currency.

The bar code representing the value of the free play coupon or cash out slip is augmented by a unique control number randomly generated by the CPU in a well-known manner. When the coupon or cash out slip is put into the bar code reader, the CPU verifies the validity of the individual coupons and cash out slips by verifying the unique control number. Additionally, control numbers for free play coupons can be generated externally and then entered into the CPU as a valid code.

The use of the above system in association with electronic gaming machines eliminates the necessity of having slot machines dedicated to a particular amount of wager. At the present time, the typical casino has slot machines that are dedicated to accept only one value of coin. For example, a slot machine may be a 25 cent machine, accepting only quarters; a 5 cent machine; or a dollar machine. It is very time consuming to physically change the slot machine, which may be desirable during a major event or New Years Eve, when slot machines having higher wager limits are desirable. By use of the subject system, it is possible to change the wager limits of any or all of the individual slot machines. Thus, the minimum wager of the slot machine can be changed at any time. It would also be possible to allow the player to select the wager limit.

This permits the casino operators to increase the usefulness of the slot machines to the casino. Previously one player desiring high wager limits than a companion would have to be separated, since the higher limit machines would be separated from the lower limit machines. The current system permits high limit machines to be next to lower limit machines, since all machines can have the values selected by the player.

Customers playing machines of different wagering limits may elect to participate in common jack pot. This will eliminate progressive carrousels from competing against themselves within the casino.

Another feature of the present invention that is advantageous to the casino is the tracking of the amount of use of the slot machines by a particular player. This is important to a casino which frequently provides perks to customers that use the casino to a significant extent. If the amount of dollars that are being played by a player is desired to be tracked, the player can insert a room key, which in the preferred embodiment is in the form of a card which has a magnetic code on it, into the slot machine which would serve to identify the player. The CPU would then store is the amount of play, time and/or money, and/or the individual player. The CPU would stop tracking the individual player when a cash out slip was generated. This system provides a complete accounting of customer accounts. Since the room key or card is only used for the identification of the player and not for providing credit, the security difficulties and interference that is experienced with the other proposals described above are not encountered. If no room key or the like is inserted, the slot machine still operates, but the player is not tracked. Other player identification means besides a room key could be used, such as providing a special identification card to the player, or having a key pad or the like with the player inserting his identification code. Once a player has inserted an identification card into a slot machine, that player can then be tracked by the insertion of any cash out slip generated by the slot machine for that player. The player would not have to insert the identification card into a slot machine as long as the player had a cash out slip.

At separate locations from the slot machines would be a "Cashiers Station" controlled by the CPU. The Cashiers Stations would not have any gaming function. In the preferred embodiment of the present invention, the Cashiers Station would pay players the value of the cash out slips. However, it is possible for the Cashier Station to provide cash tickets for use in the slot machines in exchange for currency credit card or other cash equivalents. Normally players would deposit paper currency directly into the slot machine and receive a cash out slip for the unused portion and/or winnings at the end of play. In another alternative embodiment, if a player only had coins available, then the Cashiers Station would permit the player to convert the coins to a cash out slip that could be deposited into the slot machine. Having the Cashier Station accept coins from the players would limit the collection of coins to limited locations. Also, since the slot machines would be accepting paper currency directly, many less coins would be deposited in the Cashier Station. The Cashier Station also could accept cash out slips and dispense currency by an automatic money dispenser. Some ATM devices instead of dispensing cash will dispense coupons.

The above described system overcomes the disadvantages of the prior cashless systems. The concern over counterfeiting of individual cash out slips is eliminated because the CPU will be able to keep track of the unique random number for each cash out slip or coupon. When a cash out slip or coupon is entered into the bar code reader, the CPU will determine the validity of the code, and if invalid for any reason, such as it already having been used or cashed, the CPU would not give any credit for the cash out slip or coupon and a silent alarm would be used to alert security personnel to go to the specific slot machine when an invalid code was attempted to be used.

In effect, the system of the present invention permits the player to use the gaming machines in exactly the same manner as if the player was using money. This means that the player does not have to change any playing habits, a very significant factor.

OBJECTS OF INVENTION

It is an object of the present invention to provide a gaming apparatus that does not need to use coins;

It is another object of the present invention to provide an improved gaming apparatus that is convenient for the player to use;

It is still another object of the present invention to provide a gaming apparatus that is reliable;

It is a further object of the present invention to provide a gaming apparatus that does not require the player to change his playing habits;

It is yet another object of the present invention to provide a gaming apparatus that can accept preprinted free play coupons;

It is yet another object of the present invention to provide a gaming apparatus that can use currently commercially available electronic components;

It is yet another object of the present invention to provide a gaming apparatus that increases the usability of the slot machines in the casino;

It is yet another object of the invention to provide controls and accountability far superior to existing devices;

These and other objects of the present invention will be apparent from a review of the following specification and the accompanying drawings.

DETAILED DESCRIPTION OF THE DRAWINGS

Figure 1:
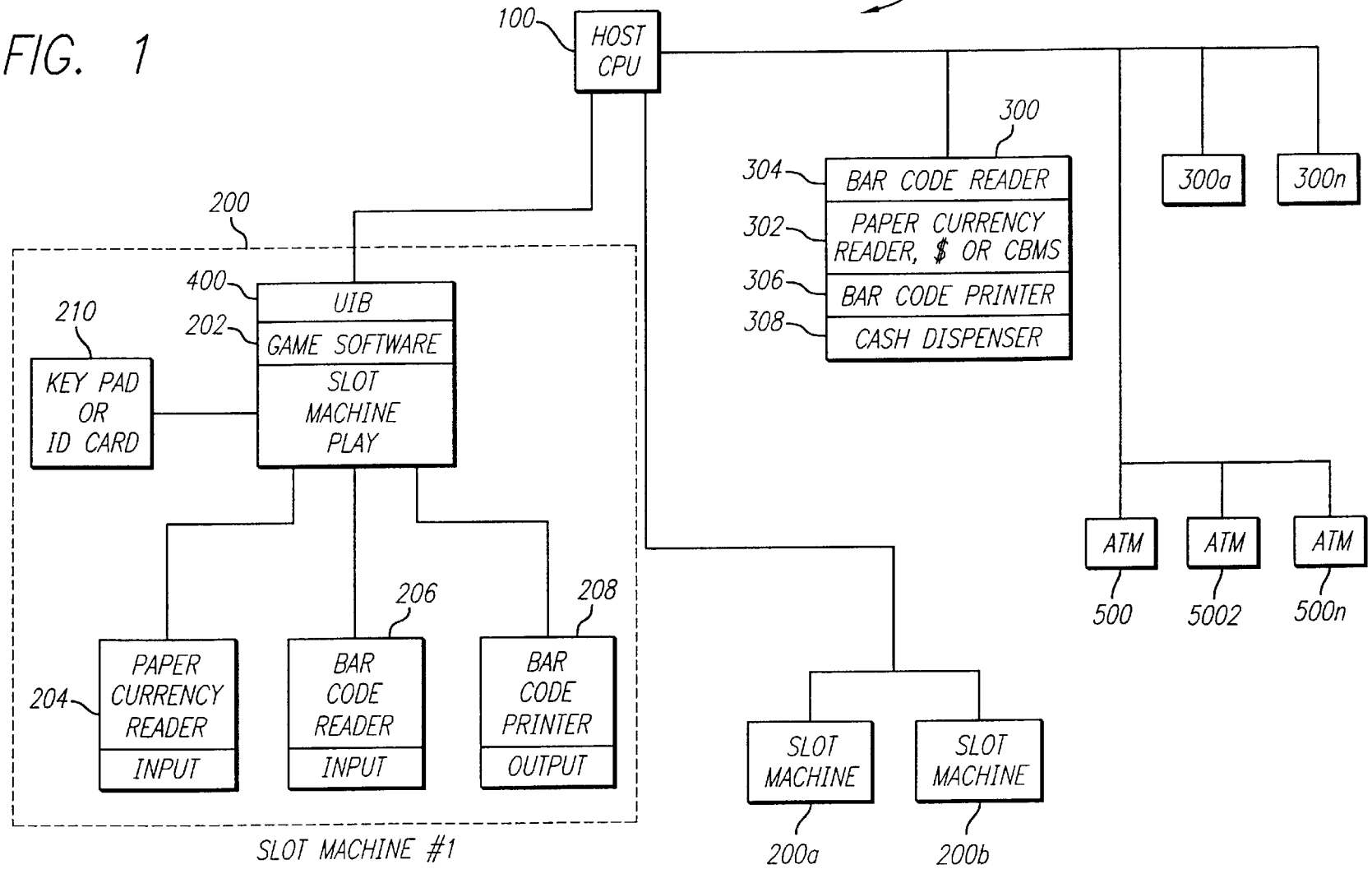
FIG. 1 is a diagrammatic block diagram of the system of the present invention.

Referring to FIG. 1, the block diagram of the components of the invention are shown. The System 10 comprises components all of which are currently available from existing technology. The system itself is referred to as a Coinless Gaming System and is referred to generally by reference 10.

Figure 5A:
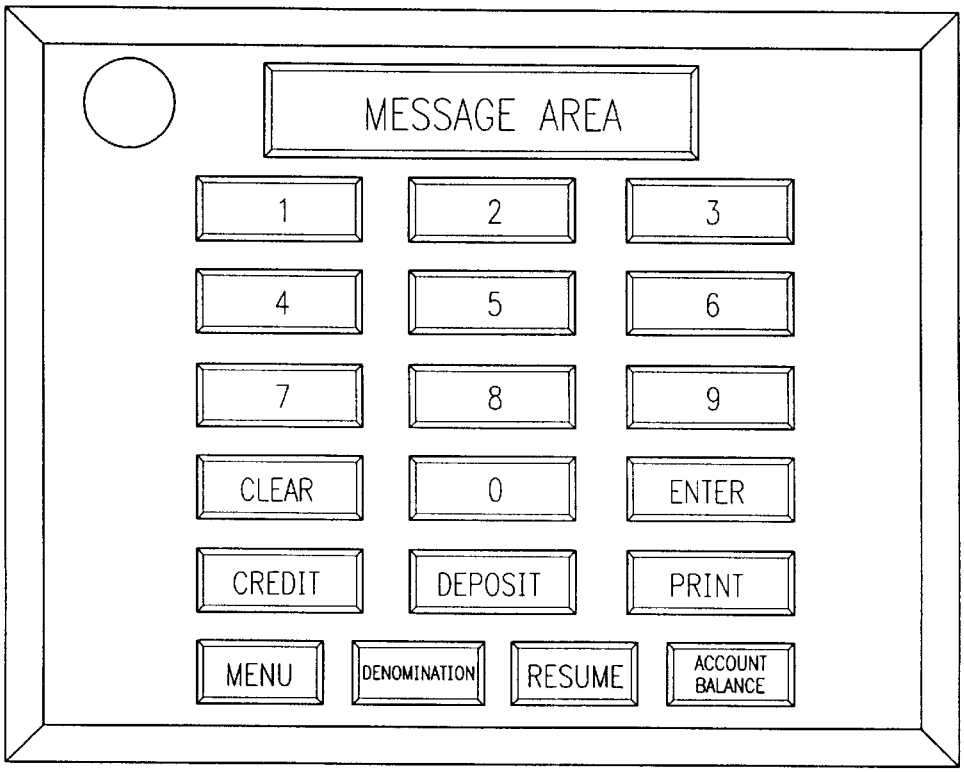
FIGS. 5*a* and 5*b* are exemplars of typical menu screens capable of being displayed with the gaming apparatus of the present invention.
Figure 5B:
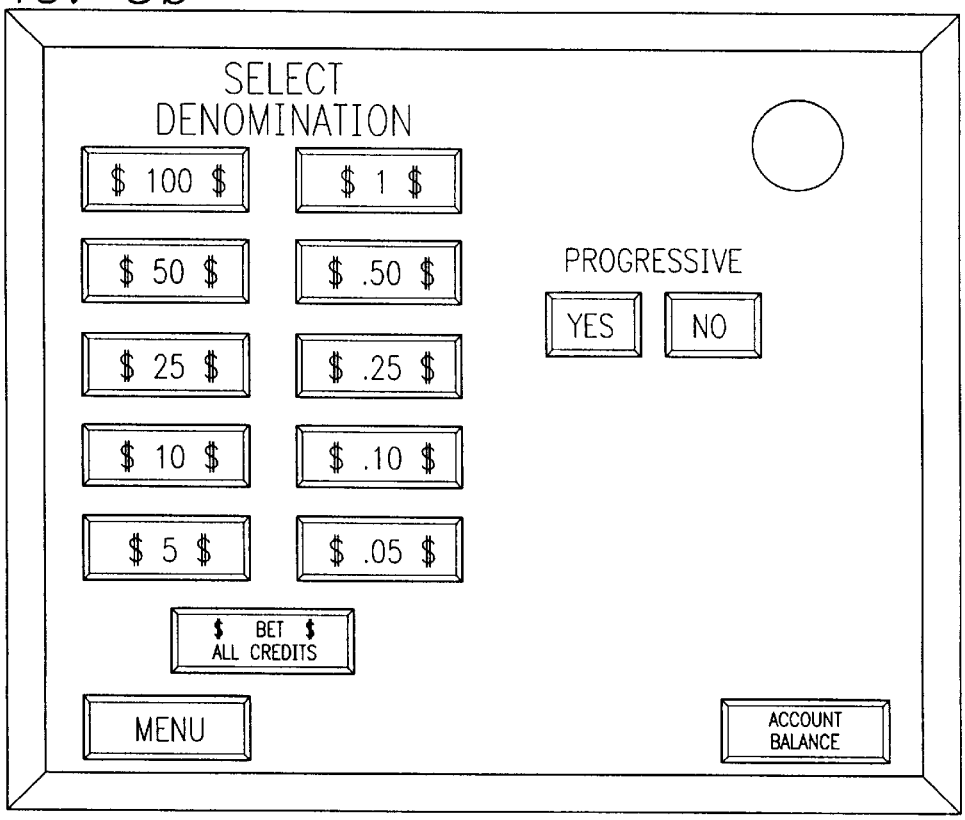

The Coinless Gaming System is controlled by a host central processing unit (CPU) 100 consisting of a stand alone computer having all of the conventional attributes of a general purpose computer. In the preferred embodiment a status brand fault tolerant computer is used. The CPU 100 is connected to a series of gaming apparatus, such as slot machines 200, 200*a* . . . *n*. The play of the slot machine 200 is controlled by internal game software 202 with preset parameters for the play of the game. In the preferred embodiment the desired game to be played is selected from a touch screen operable menu (shown in FIGS. 5*a* and 5*b*) whereby the player can select the particular game that the player wishes to play, as well as other options, such as the amount of the wager. For example, the menu may provide the player with the options of playing blackjack, conventional slots, poker, horse racing, roulette, or any other game available on software. The player can also select the amount of the wager, for example in units of 25 cents, $1.00 or any other amount permitted by the menu. The technology for touch screen menu driven devices is known. Such touch screen of the present invention is sold commercially by Video Gaming Technology, Inc. and others. The CPU 100 controls the various menu driven options, such as game selection and amount of the wager for the game.

The slot machine 200 includes a first input means in the form of a paper currency reader 204. The paper currency reader provides a signal to the CPU 100 indicating that it is valid currency and value of the currency. The CPU then authorizes the appropriate credit to the gaming apparatus. The paper currency reader 204 is well known in the trade and is commercially available from numerous companies, including J.C.M.

While in the preferred embodiment the paper currency reader 204 will be limited to United States paper currency, it is possible to have several different paper currency readers or one reader that recognize a variety of international currencies. The CPU 100 can have the current exchange rates for purposes of determining the credit available to the player.

Figures 2, 3, 4:
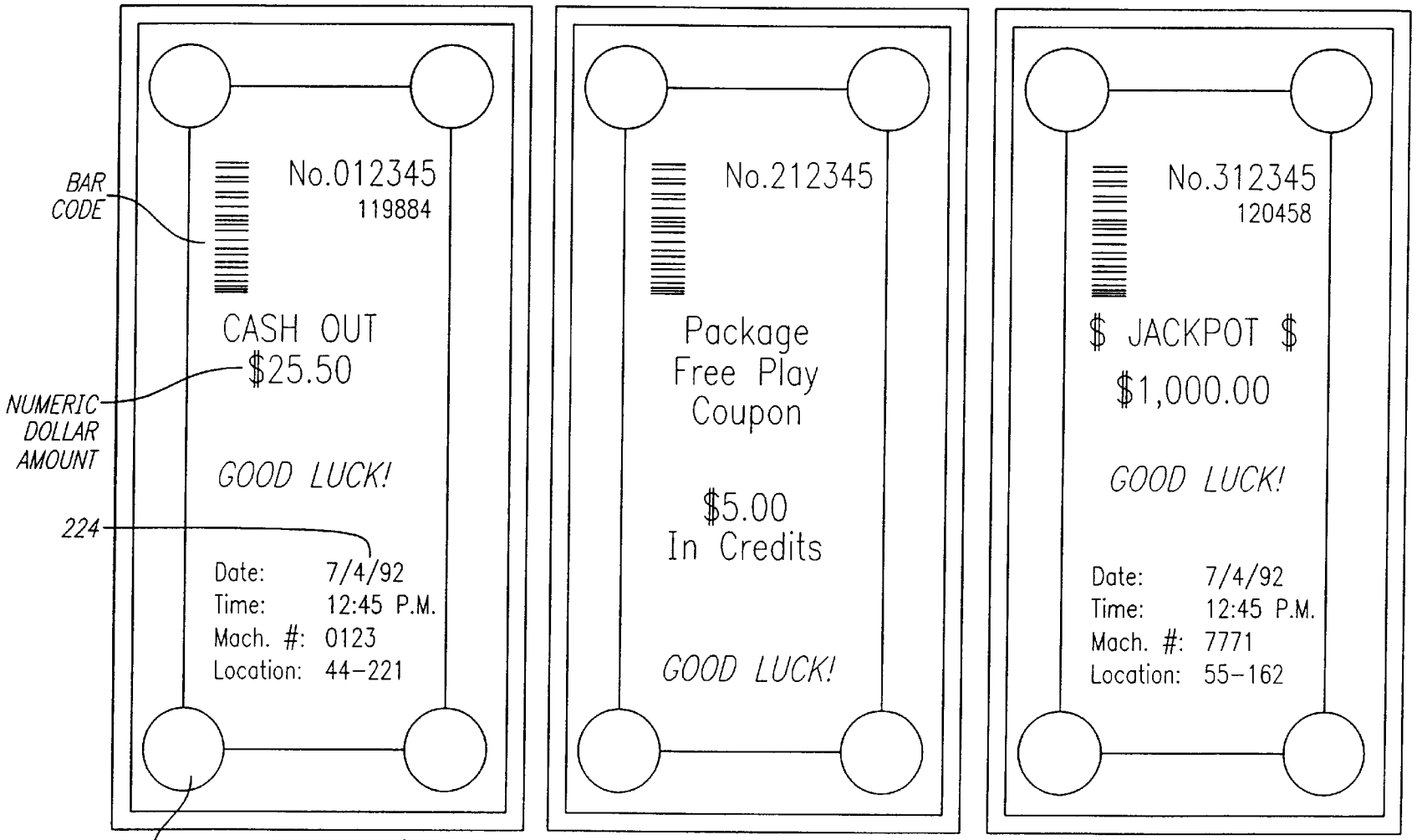
FIG. 2 is an exemplar of a typical cash out slip from the gaming apparatus of the present invention.
FIG. 3 is an exemplar of a coupon capable of being used with the gaming apparatus of the present invention.
FIG. 4 is an exemplar of a jackpot winner cash out slip from the gaming apparatus of the present invention.

The slot machine 200 has a second input means in the form of a bar code reader 206. The operation of bar code readers are well known and in the preferred embodiment a bar code reader commercially available from Triad is used. While in the preferred embodiment the bar code is inserted in the form of a permanent storage means, such as on a paper cash out slip, such as shown in FIG. 2, or free play coupon shown in FIG. 3, or Jackpot pay out ticket shown in FIG. 4, each of which has a bar code on the ticket for reading by the bar code reader, it is recognized that other forms of codes can be used in its place, such as coded magnetic strips on plastic cards.

While in most cases the free play coupons will be in the form of a monetary value, preprinted free play coupons not having money values associated with them, but other forms of play are possible. For example, the coupon may be used to permit the player to compete in a contest for the best hand in a casino wide poker contest, or other promotional purposes.

In the preferred embodiment, the paper currency reader 204 and the bar code reader 206 are located within the housing of the slot machine 200 so that the free play coupons, cash out slips and paper currency are all entered within a single slot and stored on top of each other in a single lock box that would be removable from the slot machine by authorized personnel. However, it is also possible to have the paper currency deposited in a separate slot from the free play coupons or cash out slips and stored separately.

The slot machine also includes a bar code printer 208 for printing cash out slips 220 having bar codes 222 on a permanent storage medium, such as paper, which is stored within the housing. In addition to the bar code the cash out slip 220 may also contain other information such as the date 224 of the print out of the cash out slip 222. A simple roll of preprinted cash out slips should be sufficient to generate from 400 to 800 cash out slips. A sensor can signal the CPU 100 when only ten (10%) percent, or some other amount, of the coupons are remaining so that the paper can be changed. The printer 208 prints a bar code as directed by the CPU 100. Such printers are well known. In the preferred embodiment of the present invention the bar code printer 208 is commercially available from Star Micronics.

The printer 208 prints a bar code 222 on the cash out slips 220 responsive to the instructions from the CPU 100. The CPU 100 generates the bar code to be printed. The bar code 222 represents the monetary value of the value of the credit stored in the particular slot machine 200 on the cash out slips 220, along with a randomly generated number in order to permit the CPU 100 to verify the validity and unique identification of the cash out slip 220 at a later time. This is necessary since the bar code cash out slip 220 is capable of being inserted as an input into the bar code reader 206. Upon insertion of the cash out slip 220 into the bar code reader 206, the bar code reader 206 transmits a signal to the CPU 100 corresponding to the bar code, and the CPU 100 compares the bar code 222 on the particular cash out ticket with those stored in its memory which contains the value of the cash out slip, the unique identification, and its status. For example, the status may be "paid", in which case the cash out ticket will be consider invalid and no credit will be given for the cash out slip. Since the CPU 100 has randomly generated the unique identification, a cash out ticket can receive credit only once. The options available if the code is invalid are: (1) the slot machine will merely reject the cash out slip if it does not have any readable code, such as would be the case if it was blank paper; or (2) if there is a readable bar code, but one that is an invalid code, security will be called.

In an alternative embodiment of the present invention, when paper currency, a cash out slip or a free play coupon is inserted as an input into a slot machine 200, a status indicator in the form of a visual display of the amount of the value of the ticket, currency or free play coupon will appear on the screen, as shown in FIG. 5, with a query to the player to verify that this is the right amount. If it is not the right amount or there is some other error, then the player would be directed to call an attendant.

A third input to the CPU can be a player identification code reader 210 which is capable of reading a room key or specially encoded identification card, such as one having a magnetic strip, for identifying the player using the slot machine 200. This identification card is intended to permit the CPU 100 to keep track is of the player and the amount of time and/or money played by the identified player. The identification card is not intended to provide the player with credit so the concern over the security of the card is not significant, as would be the case if the identification card provided the player with credit or was used to store the amount of winnings of the card holder.

The identification card reader 210 input can also be a key pad which the player would use to enter a number or some other means of identification. Such key pads are will known and are commercially available.

Also associated with the CPU 100 are one or more change stations 300, 300*a* . . . *n* or convenient ATM 500, 500*a* . . . *n* devices which instead of dispensing cash, generate a coupon usable with the slot machines 200. In the preferred embodiment, the change station 300 consists of a second bar code reader 304 that accepts cash out slips 222. The validity of the cash out slip 222 is verified by the CPU 100, and if valid, paid for by the attendant. Other security devices, such as holograms and the like that can be visually inspected to provide further security may be employed as well.

In an alternative embodiment, the change station can be more automated. The change station 300 in an alternative embodiment consists of a second paper currency reader 302, a second bar code reader 304, and a second bar code printer 306 for printing bar codes on a permanent storage medium. The second currency reader 302, second bar code reader 304, and second bar code printer 306 are the same as used in the slot machine 200. The change station 300 also includes a currency dispenser 308 so that when a cash out slip 222 is inserted into the bar code reader 306, then paper currency and coins can be dispensed directly to the user. In an alternative embodiment, a coin receiver is capable of accepting coins from a player in order to print cash out slips having a bar code, in the same manner that the slot machine w00 would print out cash out slips, that could be used with the slot machines 200.

As is the case with the slot machine 200, in the event that a cash out slip 222 is inserted into the bar code reader 304, the CPU 100 will validate the cash out slip 222 by making sure that it had not already been paid or otherwise valid. If it is valid then the currency would be paid out by the Change Station attendant. The attendant could be advised of the amount of currency to be paid to the player by a monitor display or a receipt printer, such is used in cash registers. Such receipt printers are well known.

The CPU 100 is fed signals generated by the Universal Interface Board (UIB) 400 which acts as the interface between the slot machine 200 and the CPU 100. The UIB is a commercially available interface which is widely used in the gaming industry to control the operation of existing stand alone electronic gaming apparatus. In the preferred embodiment of the present invention, the Universal Interface Board is sold by Five Star Solutions, Inc.

The UIB consists of an electronic chip which collects all of the slot machine data, organizes and formats it, and then transmits the organized data to the CPU 100. The UIB 400 also acts as a controller for the operation and functions of the bar code reader 206, the printer 208, the paper currency reader 204, the player identification input and other peripherals associated with the slot machines. The UIB 400 is capable of being changed by the CPU 100 to alter any of its functions. Standard computer programming, such as is well known to computer programmers in the gaming industry, is used to select the particular parameters designed to be employed in the operation and control of the UIB 400 and the CPU 100.

While in the preferred embodiment, printed bar codes are used as the encoding means, it is also possible to use other coding means, such as magnetic codes on magnetic strips on plastic cards. The cards would be treated the same as cash out slips, but would require magnetic code readers and magnetic code generators rather than bar code readers and bar code printers.

While the present invention has been described in detail with regards to the preferred embodiment, it is appreciated that other variations of the present invention may be devised which do not depart from the inventive concept of the present invention.

What we claim is:

1. A gaming apparatus that pays credits responsive to the outcome of a game played, said gaming apparatus comprising:

a. an electronic memory means for storing an amount of credit available for the play of said game, said amount of credit being determined by at least one of the outcome of the game played and an amount of currency inputted into said gaming apparatus;

b. a first input associated with means for recognizing and validating paper currency, said first input providing a first input signal to said electronic memory means representing an amount of credit represented by said paper currency;

c. means for generating a first code on a first permanent storage record, said first code representing credit stored in said electronic memory means, and an outlet for said first permanent storage record;

d. a second input associated with means for reading said first code on said first permanent storage record; and e. means for providing a second input signal to said electronic memory means representing an amount of credit represented by said first code, said electronic memory means generating a second signal representing at least one of an amount of credit and currency to be dispensed by said gaming apparatus.

2. The gaming apparatus of claim 1 in which said first code is in the form of a bar code and said code reading means comprises a bar code reader.

3. The gaming apparatus of claim 1 in which said means for generating said first code is a bar code printer.

4. The gaming apparatus of claim 1 in which said permanent storage record is paper, said paper being stored in said gaming apparatus.

5. The gaming apparatus of claim 4 in which said paper is stored in said gaming apparatus in the form of a roll.

6. The gaming apparatus of claim 1 in which said first code is in the form of a magnetic code on a magnetic strip, and said code reading means comprises a magnetic code reader.

7. The gaming apparatus of claim 6 in which said permanent storage record is a card, said card being stored in said gaming apparatus.

8. The gaming apparatus of claim 1 in which said means for generating said first code is a magnetic code printer.

9. The gaming apparatus of claim 1 in which said code reading means reads and validates preprinted coded coupons.

10. The gaming apparatus of claim 9 comprising a means for determining the validity of said coded coupons and generating a signal to the electronic memory means corresponding to the value of said coded coupons only if valid.

11. The gaming apparatus of claim 1 in which said first code includes a security code portion for the electronic memory means to validate said first code of said first storage record.

12. The gaming apparatus of claim 11 comprising a means for accepting coded coupons.

13. A gaming apparatus that pays credits responsive to an outcome of a game played comprising:

a. an electronic memory means for storing an amount of credit available for the play of said game, said amount of credit being determined by at least one of the outcome of the game played and an amount of currency inputted into said gaming apparatus;

b. a code reader for reading a code on a permanent storage record corresponding to an amount of credit represented by said code for play of said game;

c. a means for generating a first code on a first permanent storage record representing the amount of credit stored in said electronic memory means, said first code capable of being read by said code reader; and d. means for providing a signal to said electronic memory means corresponding to the amount of credit stored in said first permanent storage record, said electronic memory means generating a second signal representing at least one of an amount of credit and currency to be dispensed by said gaming apparatus.

14. The gaming apparatus of claim 13 in which said first code is in the form of a bar code and said code reading means comprises a bar code reader.

15. The gaming apparatus of claim 13 in which said means for generating said first code is a bar code printer.

16. The gaming apparatus of claim 13 in which said permanent storage record is paper, said paper being stored in said gaming apparatus.

17. The gaming apparatus of claim 16 in which said paper is stored in said gaming apparatus in the form of a roll.

18. The gaming apparatus of claim 13 in which said first code is in the form of a magnetic code on a magnetic strip, and said code reading means comprises a magnetic code reader.

19. The gaming apparatus of claim 18 in which said means for generating said first code is a magnetic code printer.

20. The gaming apparatus of claim 18 in which said permanent storage record is a card, said card being stored in said gaming apparatus.

21. The gaming apparatus of claim 13 comprising a means for accepting paper currency.

22. The gaming apparatus of claim 21 comprising means for determining the validity of said paper currency and generating said signal to the electronic memory means corresponding to the value of said currency.

23. The gaming apparatus of claim 13 comprising a means for accepting coded coupons.

24. The gaming apparatus of claim 23 comprising means for determining the validity of said coded coupons and generating said signal to the electronic memory means corresponding to the value of said coded coupons.

25. The gaming apparatus of claim 13 comprising a paper currency recognition means for recognizing and validating paper currency and providing a first input signal to said electronic memory means representing the amount of the credit represented by said paper currency.

26. The gaming apparatus of claim 13 in which said first code is a unique code, representing the value of the amount of credit.

27. The gaming apparatus of claim 26 in which said first code is in the form of a bar code and said code reading means comprises a bar code reader.

28. The gaming apparatus of claim 26 in which said means for generating said first code is a bar code printer.

29. The gaming apparatus of claim 26 in which said permanent storage record is paper, said paper being stored in said gaming apparatus.

30. The gaming apparatus of claim 29 in which said paper is stored in said gaming apparatus in the form of a roll.

31. The gaming apparatus of claim 26 in which said first code is in the form of a magnetic code on a magnetic strip, and said code reading means comprises a magnetic code reader.

32. The gaming apparatus of claim 31 in which said means for generating said first code is a magnetic code printer.

33. The gaming apparatus of claim 31 in which said permanent storage record is a card, said card being stored in said gaming apparatus.

34. The gaming apparatus of claim 26 comprising a means for accepting paper currency.

35. The gaming apparatus of claim 34 comprising means for determining the validity of said paper currency and generating said signal to the electronic memory means corresponding to the value of said currency.

36. The gaming apparatus of claim 26 comprising a means for accepting coded coupons.

37. The gaming apparatus of claim 36 comprising means for determining the validity of said coded coupons and generating said signal to the electronic memory means corresponding to the value of said coded coupons.

38. A gaming apparatus that pays credits responsive to an outcome of a game played comprising:

a. an electronic memory means for storing an amount of credit available for the play of said game;

b. a code reader for reading a code on a permanent storage record corresponding to an amount of credit represented by said code for play of said game;

c. means for generating a first code on a first permanent storage record representing the amount of credit stored in said electronic memory means, said first code capable of being read by said code reader;

d. means for providing a signal to said electronic memory means corresponding to the amount of credit stored in said first permanent storage record; and e. an automatic pay-out system comprising:

means for validating said first code and for providing a first input signal to said electronic memory means representing an amount of credit represented by said first code, said electronic memory means generating a second output signal representing the amount of currency to be dispensed;

means for storing currency within said gaming apparatus;

means for recognizing and distinguishing different values of currency and for dispensing said currency in response to said second output signal from said electronic memory system.

39. The gaming apparatus of claim 38 in which said first code is in the form of a bar code and said code reading means comprises a bar code reader.

40. The gaming apparatus of claim 38 in which said means for generating said first code is a bar code printer.

41. The gaming apparatus of claim 38 in which said permanent output record is paper, said paper being stored in said gaming apparatus.

42. The gaming apparatus of claim 41 in which said paper is stored in said gaming apparatus in the form of a roll.

43. The gaming apparatus of claim 42 in which said permanent storage record is a card, said card being stored in said gaming apparatus.

44. The gaming apparatus of claim 38 in which said first code is in the form of a magnetic code on a magnetic strip, and said code reading means comprises a magnetic code reader.

45. The gaming apparatus of claim 44 in which said means for generating said first code is a magnetic code printer.

46. The gaming apparatus of claim 38 comprising a means for accepting paper currency.

47. The gaming apparatus of claim 46 comprising a means for determining the validity of said paper currency and generating a second input signal to the electronic memory means corresponding to the value of said currency.

48. The gaming apparatus of claim 38 comprising a means for accepting coded coupons.

49. The gaming apparatus of claim 48 comprising a means for determining the validity of said coded coupons and generating a second input signal to the electronic memory means corresponding to the value of said coded coupons.

50. The gaming apparatus of claim 38 comprising a paper currency recognition means for recognizing and validating paper currency and providing a second input signal to said electronic memory means representing the amount of the credit represented by said paper currency.

51. The gaming apparatus of claim 38 in which said first code is a unique code, representing the value of the amount of credit.

52. The gaming apparatus of claim 51 in which said first code is in the form of a bar code and said code reading means comprises a bar code reader.

53. The gaming apparatus of claim 52 in which said means for generating said first code is a bar code printer.

54. The gaming apparatus of claim 52 in which said permanent output record is paper, said paper being stored in said gaming apparatus.

55. The gaming apparatus of claim 54 in which said paper is stored in said gaming apparatus in the form of a roll.

56. The gaming apparatus of claim 51 in which said first code is in the form of a magnetic code on a magnetic strip, and said code reading means comprises a magnetic code reader.

57. The gaming apparatus of claim 56 in which said means for generating said first code is a magnetic code printer.

58. The gaming apparatus of claim 56 in which said permanent storage record is a card, said card being stored in said gaming apparatus.

59. The gaming apparatus of claim 51 comprising a means for accepting paper currency.

60. The gaming apparatus of claim 59 comprising a means for determining the validity of said paper currency and generating a second input signal to the electronic memory means corresponding to the value of said currency.

61. The gaming apparatus of claim 51 comprising a means for accepting coded coupons.

62. The gaming apparatus of claim 61 comprising a means for determining the validity of said coded coupons and generating said signal to the electronic memory means corresponding to the value of said coded coupons.

63. A method for employing a gaming apparatus, said gaming apparatus consisting of:

a. a game that pays credits responsive to the outcome of the game played, said game being associated with an electronic memory means for storing the amount of credit available for the play of said game, said amount of credit being determined by at least one of the outcome of the game played and an amount of currency inputted into said gaming apparatus;

b. means for recognizing and validating paper currency and providing a first input signal to said electronic memory means representing an amount of the credit represented by said paper currency;

c. means for generating a code on a permanent storage record representing an amount of credit stored in said electronic memory means, said electronic memory means generating a second signal representing at least one of an amount of credit and currency to be dispensed by said gaming apparatus;

d. a code reading means for reading said code on said permanent storage record and means for providing a second input signal to said electronic memory means representing the amount of credit represented by said code;

said method comprising the steps of:

(1) depositing paper currency or a permanent storage record having a code in the paper currency recognition means or code reading means; and (2) upon completion of use of the gaming apparatus generating a first permanent storage record corresponding to the amount of credit stored in said electronic memory means available for play of said game.

64. The method of claim 63 further including the steps of inserting the first permanent storage record at a remote location in a second code reader means associated with said second code reader indicating the value of the credits.

65. A change station comprising an exchange system for providing currency in exchange for credits generated by a game in response to the outcome of the game played and for providing credits in exchange for currency, said change station, comprising:

means for receiving a first permanent storage record having a first code corresponding to an amount of credit for playing said game;

means for reading said first code on said first permanent storage record;

means for validating said first code and for providing a first signal to an electronic memory representing the amount of credit represented by said first code;

means for storing currency, and means for recognizing and dispensing currency in response to a second signal from said electronic memory representing the amount of currency to be dispensed;

means for accepting currency into said change station; and means for generating a second code on a second permanent storage record representing the amount of currency accepted by said currency accepting means, said second code on said second permanent storage record being readable by said code reading means.

66. A gaming system comprising:

a. a game that pays credits responsive to the outcome of the game played, said game associated with an electronic memory means for storing an amount of credit available for the play of said game;

b. means for generating a first code on a permanent storage record representing the amount of credit stored in said electronic memory means;

c. a change system for providing currency in exchange for said credits;

d. input means for receiving a permanent storage record;

e. code reading means for reading said first code on said permanent storage record;

f. means for validating said first code and for providing a first signal to said electronic memory means representing the amount of credit represented by said first code; and g. means for storing currency, and means for recognizing and dispensing currency in response to a second signal from said electronic memory means representing the amount of currency to be dispensed.

67. The gaming apparatus of claim 66 in which said first code is in the form of a bar code and said code reading means comprises a bar code reader.

68. The gaming apparatus of claim 66 in which said first code is in the form of a magnetic code on a magnetic strip, and said code reading means comprises a magnetic code reader.

69. The gaming apparatus of claim 68 in which said permanent storage record is a card, said card being stored in said gaming apparatus.

70. The gaming apparatus of claim 66 comprising a means for accepting coded coupons.

71. The gaming apparatus of claim 70 comprising a means for determining the validity of said coded coupons and generating a signal to the electronic memory means corresponding to the value of said coded coupons.

72. The gaming apparatus of claim 66 in which said first code is a unique code representing the value of the amount of credit.

73. The gaming apparatus of claim 72 in which said first code is in the form of a bar code and said code reading means comprises a bar code reader.

74. The gaming apparatus of claim 72 in which said first code is in the form of a magnetic code on a magnetic strip, and said code reading means comprises a magnetic code reader.

75. The gaming apparatus of claim 74 in which said permanent storage record is a card, said card being stored in said gaming apparatus.

76. The gaming apparatus of claim 72 comprising a means for accepting coded coupons.

* * * * *